US007604872B2

(12) United States Patent
Rosende et al.

(10) Patent No.: US 7,604,872 B2
(45) Date of Patent: Oct. 20, 2009

(54) CORROSION RESISTING JOINING AREA AND METHOD BETWEEN MATERIALS OF COPPER AND STAINLESS STEEL OR TITANIUM, WHICH ARE THE CONSTITUENTS OF PERMANENT CATHODES FOR ELECTROLYTIC PROCESSES AND CATHODES OBTAINED

(75) Inventors: Antonio Carracedo Rosende, Calama (CL); Horacio Rafart Mouthon, Santiago (CL)

(73) Assignee: Industria Proveedora de Partes Metalurgicas Limitada, Calama (CL)

( * ) Notice: Subject to any disclaimer, the term of this patent is extended or adjusted under 35 U.S.C. 154(b) by 286 days.

(21) Appl. No.: 11/121,856

(22) Filed: May 3, 2005

(65) Prior Publication Data

US 2006/0249379 A1 Nov. 9, 2006

(30) Foreign Application Priority Data

May 3, 2005 (CL) ..... 941-2004

(51) Int. Cl.
*B32B 15/01* (2006.01)
*B32B 15/02* (2006.01)
*B32B 15/18* (2006.01)
*B32B 15/20* (2006.01)

(52) U.S. Cl. ..... 428/677; 428/615; 428/675; 428/678; 428/685

(58) Field of Classification Search ..... None
See application file for complete search history.

(56) References Cited

U.S. PATENT DOCUMENTS 4,139,430 A * 2/1979 Parkinson et al. ..... 205/575
4,186,074 A * 1/1980 Perry ..... 204/288.2
4,406,769 A * 9/1983 Berger ..... 204/281
4,647,358 A * 3/1987 Bartsch et al. ..... 204/288.2
4,670,124 A * 6/1987 Bartsch et al. ..... 204/288
4,764,260 A * 8/1988 Gay et al. ..... 205/178
2003/0010630 A1* 1/2003 Polvi et al. ..... 204/280
2004/0232002 A1* 11/2004 Rantala et al. ..... 205/337

OTHER PUBLICATIONS

DE 4241485 English Machine Translation, Gerhard et al., Mar. 1994.*

* cited by examiner

*Primary Examiner*—Jennifer McNeil
*Assistant Examiner*—Jason L Savage
(74) *Attorney, Agent, or Firm*—Greenberg Traurig LLP

(57) ABSTRACT

This disclosure provides a joining area and method between copper and stainless steel or titanium, as well as the permanent cathode obtained, where said joining area is made of a first zone of a copper-nickel (Cu—Ni) alloy, an intermediate zone with a mostly nickel alloy or pure nickel and a second zone made of a stainless steel-nickel alloy, which is the result of the participating materials being cast in an arc welding process, for example TIG, MIG or manual arc using electrodes of nickel as welding contributor between said materials and their space arrangement, that is to say, leaving a separation between the materials when performing the welding process, thus ensuring as follows: a) greater tensile strength, b) a substantial improvement of corrosion resistance of the joint welding, and c) improvement of conductibility, which can be improved still further by modifying the straight design of the conducting bar by providing it with the "horn"-type shape.

7 Claims, 4 Drawing Sheets

CORROSION RESISTING JOINING AREA AND METHOD BETWEEN MATERIALS OF COPPER AND STAINLESS STEEL OR TITANIUM, WHICH ARE THE CONSTITUENTS OF PERMANENT CATHODES FOR ELECTROLYTIC PROCESSES AND CATHODES OBTAINED

RELATED APPLICATIONS

This application claims priority to Chilean Patent Application Number 941-2004, filed on May 3, 2004, the contents of which application is incorporated herein by reference in its entirety.

BACKGROUND

1. Field

This disclosure relates to the mining industry, more specifically to copper electro refining or electro winning, more specifically to corrosion resisting joining areas between materials of copper and stainless steel or titanium, which are the constituents of permanent cathodes for electrolytic processes.

2. General Background

SUMMARY

In order to settle the issue of corrosion completely, this disclosure provides a joining system and method between copper and stainless steel or titanium, as well as the permanent cathode obtained, where said joining area is the result of a voltaic arc welding process, for example TIG, MIG or manual arc, where the performance of grooves in the conducting bars is not essential for the insertion of the stainless steel or titanium plate, using electrodes of nickel or nickel alloy as contributor with a procedure ensuring as follows: a) greater tensile strength, b) a substantial improvement of corrosion resistance of the joint welding, and c) improvement of conductibility, which can be improved still further by modifying the straight design of the conducting bar by providing the "horn"-type shape to such an extent that—depending on the operating features of the different mining plants—it may be 2.5 times better than conventional cathodes, that is to say, without coating.

The resulting cathode of this disclosure, which may be a new or a repaired one, has other advantages in addition to those already mentioned, such as simplicity of manufacture, which results in a substantially lower manufacture cost, which in turn represents a very important progress in the technology of the production of such much used metals as copper.

DESCRIPTION OF PRIOR ART

Permanent cathodes for electrolytic processes of copper production consist in a conducting bar and a plate or sheet made of stainless steel or titanium placed in an electrolyte solution hanging from the conducting bar.

A repeating issue of all producers of electrolytic copper is how to optimize the permanent cathode both in cost and quality, with the most relevant aspects of this being the quality of the plate itself, conductivity between the plate and the conducting bar, its mechanical strength and the strength of the assembly to corrosion.

The first permanent cathodes were totally made of titanium, that is to say, the plate and the conducting bar were of titanium, since it was then a well-proven corrosion resisting element with superb features for the later deplating of the copper plate obtained. Later, and due to its high cost, the technology of permanent cathodes made of stainless steel was developed, which is now—after a number of development in this respect—at its peak in the system developed by the Canadian company Falconbridge Limited, called "Basic reusable cathode sheets made of stainless steel for the electro refining or electro winning of copper", patented in 1988 under number CL 39.322 (FIG. 1). This system basically consisted in a copper coated steel conducting bar of a certain thickness to which a stainless steel plate was welded, having a number of projections in its upper end to hold the conducting bar on both sides alternately. This inventive system which operated for many years faced resistance by the users, since its conductivity decreased over the operation time, because the copper coated steel conducting bar became isolated as the result of the fact that the iron-copper joint was of a contact type and not a metallurgical one. Thus, the acid mist from the operation introduced between the faces increasing corrosion and isolation as a consequence. A faulty contact increasing voltage drop between the conducting bar and the receiving plate of the electrolytic deposit just some tenths of volts, multiplied by the thousands of electrodes operating in a refinery and multiplied by the huge currents in circulation increase the operating cost substantially.

The next technological breakthrough dealt with the implementation of a system able to ensure the voltage drop during the useful life of the electrode and also able to ensure that this drop could be minimum. Thus, after a number of designs, copper producers adopted the system developed by Perry, patent U.S. Pat. No. 4,186,074 dated Jan. 29, 1980 (FIG. 2), consisting just in a stainless steel conducting bar welded to the stainless steel plate to collect the electrolytic deposit and the whole cathode head. This was coated up to about 25.4 mm (1") below the conducting bar with a copper electrolytic deposit which enhanced the electric conductivity of the assembly. This type of cathode has been called "solid drawn cathode", but the U.S. Pat. No. 4,764,260 dated Aug. 16, 1988, called "Process for electroplating nickel over stainless steel" developed this joining system related to the technology to produce an electrolytic deposit which adheres over the stainless steel.

The purpose of this solution was the same as the prior one, that is to say, its voltage drop increased after a while due to the isolation produced by the separation of the copper coating from the stainless steel due to the corrosion produced by the acid mist of the electrolytic operation which gives form to a type of wedge, thus separating the copper deposit from the stainless steel. In addition, the system's conductivity was not the best one either, since the electrolytic deposits—although the deposit was made of copper—did not perform a good conduction, because its molecular structure is not crystalline.

The patent document U.S. Pat. No. 5,492,609 as of Feb. 20, 1996 called "Cathode for electrolytic refining of copper" developed by William Assenmacher for TA Caid Industries, Inc. (FIG. 3), discloses the joint of a conducting bar with the steel plate by inserting in a fretwork of the steel plate—and perpendicular to it—the conducting bar along its cross section, which is later welded through the TIG (tungsten inert gas) system using copper as contributor due to the form of the fretwork made in the conducting bar. The contributor for the welding comes indeed from the same bar and it is achieved by leaving two rectangular sections along the joining area trough proper milling. This system ensures a great mechanic strength and also superb conductivity, since welding takes place through the whole section of the conducting bar which is in turn of copper. This type of cathode is called "conventional cathode", but a drawback of this cathode is a lesser useful life than the prior ones, because in the joining area of the "copper bar-stainless steel plate" resulting from the TIG process, a copper-stainless steel alloy of a very bad resistance to acid mist is produced, with welding being quickly corroded and the plate becoming detached, which involves a major operating and economic issue.

The patent application CL 1303-02 still being processed, submitted on Jun. 14, 2002 called "Permanent cathode made up of a conducting bar, a plate of stainless steel or titanium, where said bar is composed of a peripheral double-layer coating; a method and a system to manufacture said cathodes", which inventors are Horacio Rafart and Patricio Carracedo and incorporated hereinto as reference, proposes a double copper peripheral coating over the cathode head of a crystalline structure inside and of electrolytic type outside, which ensure the electric conductivity and resistance to corrosion respectively. This kind of cathode is called "electrolytic ally coated cathode", but the "copper bar-stainless steel plate" joining area resulting from the TIC welding still exists under this coating and the corrosion issue is not settled completely, although satisfactory and better results are achieved with this coating.

The two prior documents are based on performing a groove in the conducting bar in order to insert the stainless steel or titanium plate, while in this disclosure said groove is not essential.

DRAWINGS

The above-mentioned features and objects of the present disclosure will become more apparent with reference to the following description taken in conjunction with the accompanying drawings wherein like reference numerals denote like elements and in which.

Figure 1:
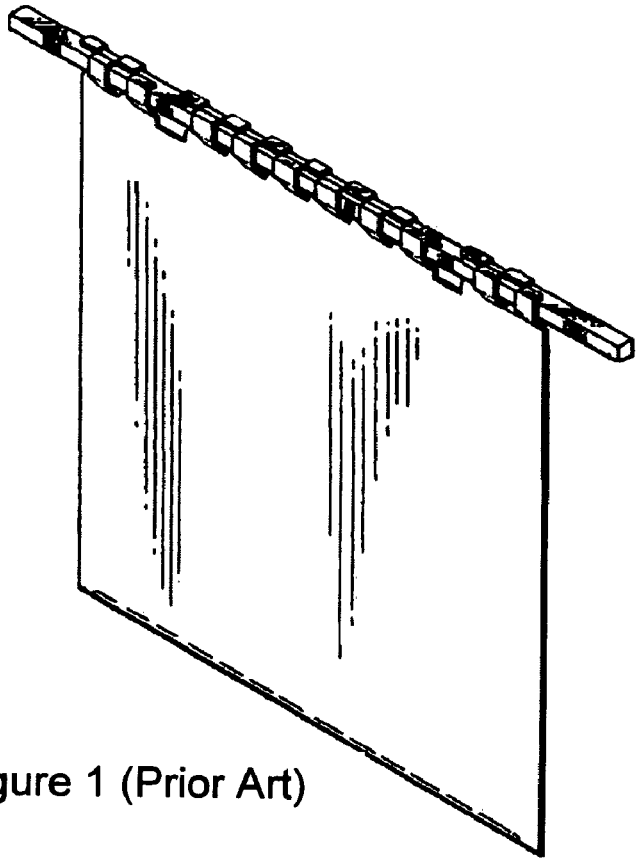
Figure 1 (Prior Art)
FIG. 1 (prior art) shows the cathode developed by the company Falconbridge Limited.
Figure 2:
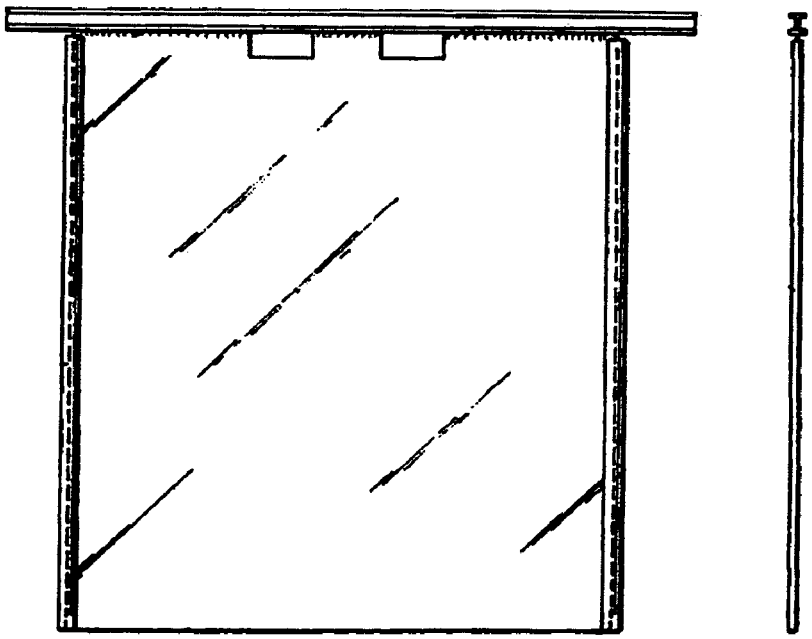
Figure 2 (Prior Art)
FIG. 2 (prior art) shows the cathode called "solid drawn cathode."
Figure 3:
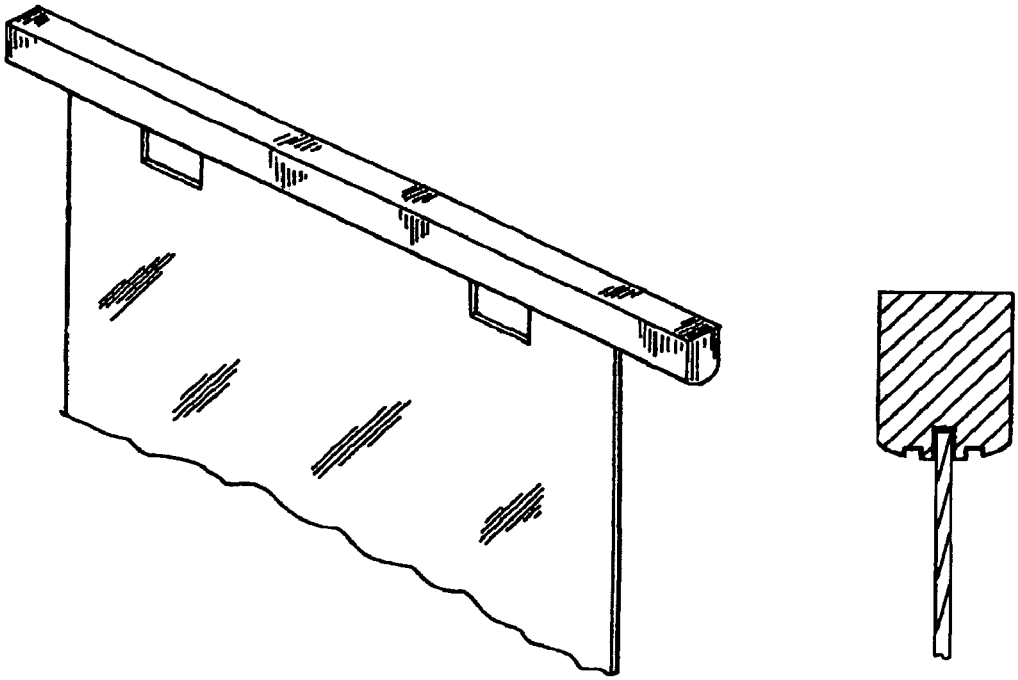
Figure 3 (Prior Art)
FIG. 3 (prior art) shows the cathode called "Conventional cathode" developed by T A Caid Industries, Inc.
Figure 4:
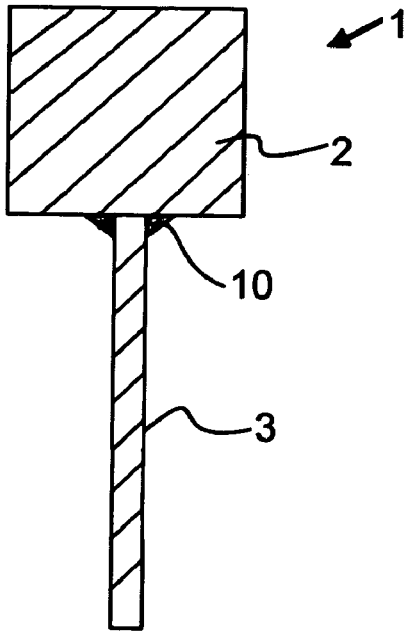
FIG. 4 is a cross-section of a cathode of this disclosure.
Figure 5:
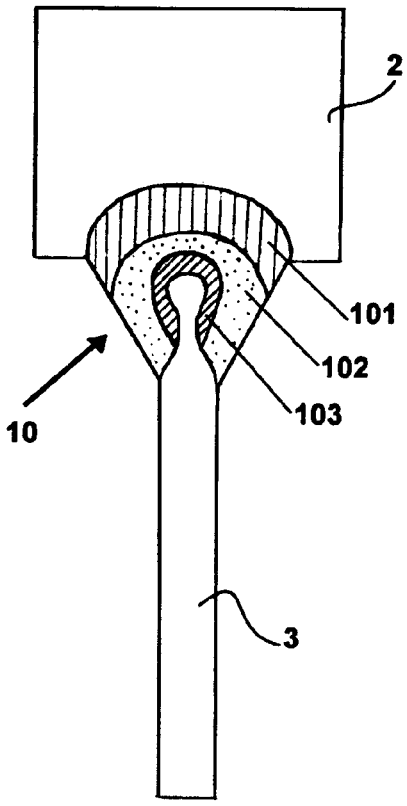

FIG. 5 corresponds to a cross-section of the conducting bar and stainless steel or titanium plate after the production of a welding with nickel and showing different areas of alloy.

Figure 6:
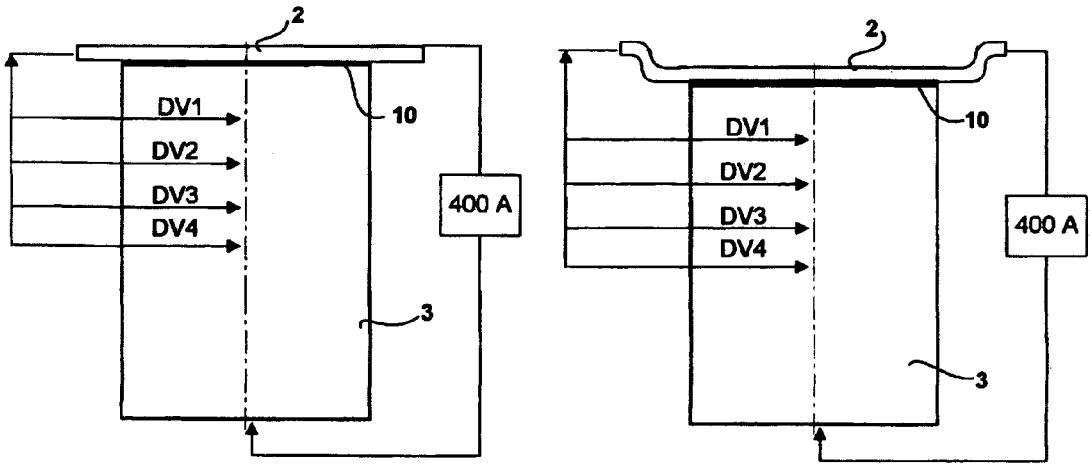

FIG. 6 shows the cathodes of the disclosure and measurement points of voltage drop between different points below the conducting bar.

Figure 7:
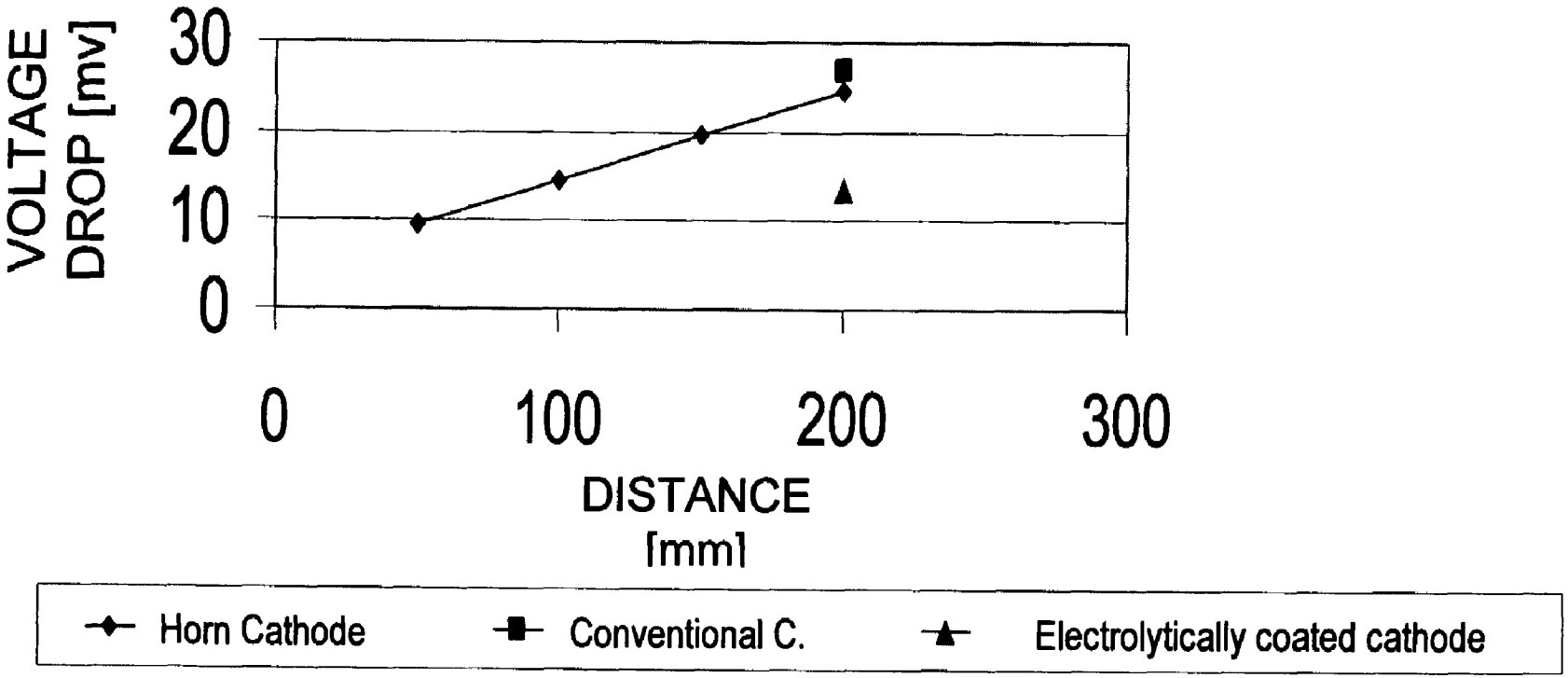

FIG. 7 shows the chart of voltage drops to the center of cathode in the different points shown in FIG. 6.

DETAILED DESCRIPTION

The disclosure provides a copper conducting bar (2) which may be straight or "horn" shaped. The height of the section horizontal to this horn and its curvature radius is in agreement with the design of cells and operating features of each electrolytic plant.

In order to be able to carry out the welding process and provide the joining area (10) between the conducting bar (2) and the stainless steel or titanium plate (3), the conducting bar undergoes a comprehensive cleaning process through proper agents in order to ensure the quality of the later welding. The conducting bar (2) which is usually of the rectangular type is placed over its bottom thin face and inverted on an assembly table, with the edge of the stainless steel plate (3) being supported perpendicular and centered to the edge of the conducting bar (2); then it is properly fastened in this position and welding takes place through the TIG, MIG or manual arc process by using electrodes of pure nickel or nickel alloys with a high content of nickel as contributing welding along the whole section of the stainless steel plate (3).

The joining area (10) resulting from the TIG or manual arc type welding process with nickel or alloys with a high content of nickel, shows much lower corrosion rates than the conducting bar itself (2) and than the stainless steel plate (3). Cathode (1) of this disclosure was indeed subjected to an accelerated electro-corrosion process along with the cathode called "conventional cathode", where the following could be seen: cathode (1) of this disclosure, corrosion over the copper conducting bar (2) and, later, corrosion over the stainless steel plate (3), while the joining area (10) of welding with nickel remained unchanged on both sides of the joint area (10).

Prior experimental data are explained by the joining method used. As it may be seen in FIG. 5, the joining area (10) is formed by different zones inside as the result of participating materials becoming cast in the TIG or manual arc welding process and due to the space arrangement between the copper conducting bar (2) and the stainless steel plate (3) when performing the welding process. In this way, a first zone (101) is reached next to the copper conducting bar (2) made of a copper-nickel alloy (Cu—Ni), while in the other end of the joining area (10) next to the stainless steel plate (3), a second zone (103) is reached made of a stainless steel-nickel alloy, while in the central portion of the joining area (10) an intermediate zone (102) is formed with an alloy mostly of nickel or pure nickel. This kind of alloys and pure nickel are quite more resistant to corrosion than pure copper and stainless steel.

It should be pointed out that the space arrangement mentioned in the preceding paragraph relates to a preset separation being left between the materials to be welded in a range from 0.1 mm to 1 mm, more preferably between 0.1 mm and 0.5 mm. But also a fretwork can be done to the conducting bar (2) in order to insert the stainless steel plate (3) thus eliminating the separation between the materials to be welded. This type of insertion therefore can be done and then the applicable welding in order to form the area (10) of this disclosure. Lower quality is obtained from the intermediate zone (102) as to the level of nickel in the alloy achieved. Anyway, and upon the stainless steel plate (3) being inserted in a fretwork of the conducting bar (2), this joining area (10) still has better properties against corrosion, tension and conductibility than the welding areas of conventional cathodes among others.

When the so-called "conventional cathode" underwent the corrosion test, the total detachment of the stainless steel plate due to the corrosion of the welding in the cathode head could be seen 7 days after the test, while cathode (1) endured the corrosive action over two months until disappearing from the conducting bar (2). The stainless steel plate (3) showed deep corrosion, while the joining area (10) remained almost unaltered. Due to this, it may be concluded that the useful life of cathode (1) of this disclosure is associated with the useful life of the stainless steel plate (3) since, although it is true that the copper bar (2) is quite more corrosible, its dimensions and the operating system of copper refineries give it an already proven useful life quite over 5 or 6 years than the stainless steel plate of a cathode.

As to the conductibility properties of cathodes, this is traditionally measured by the voltage drop in the center of the stainless steel plate and is produced by the distance between the conducting bar and the upper level in the electrolyte achieved in the stainless steel plate when applying a 400 A current (FIG. 6). Conventionally a distance of 200 mm has been adopted, which provides a voltage drop called ΔV4. Although it is true that cathode conductibility can be improved by reducing the distance mentioned above, that is to say, by allowing a greater upper level of the electrolyte in the stainless steel plate, we again have the problem of corrosion due to the action of the acid mist from the electrolytic process.

Cathode (1) of this disclosure has a ΔV4 of about 24 [mV], with the ΔV4 value of the conventional cathode being higher, but the electrolytic ally coated cathode has a ΔV4 lower than this value, this being why a voltage drop to lesser values is necessary. This problem is settled with the "horn" shape provided to the copper conducting bar (2), as appreciated in FIG. 6, which allows reducing the 200 mm distance to a much lesser distance, even reaching distances of 50 mm, since the corrosion problem has been settled allowing this kind of solution in order to improve the cathode conductibility.

Below, table 1 is shown, which is a table comparing the voltage drops between the conventional cathode, the electrolytic ally coated cathode and that of this disclosure called "horn" type and which results may be appreciated in the chart of FIG. 7.

TABLE 1

Voltage comparative table to the center of stainless steel cathodes

| Type of cathode | Voltage drop | Distance L [mm] | Voltage [mV] |
|---|---|---|---|
| Horn | ΔV1 | 50 | 9.65 |
| | ΔV2 | 100 | 14.6 |
| | ΔV3 | 150 | 19.75 |
| | ΔV4 | 200 | 24.45 |
| Conventional | ΔV4 | 200 | 26.9 |
| Electrolytically coated | ΔV4 | 200 | 13.42 |

Table 1 above shows different measurements of voltage drop over the cathode, between different points below the conducting bar in the center of the stainless steel plate and the end of the copper bar of each cathode with a circulating current of 400 A (FIG. 6). The result obtained allows ensuring that with a 50 mm distance, the cathode conductivity increases 2.5 times as to a conventional cathode and 50% as to the electrolytic ally coated cathode.

This simple effect of approaching the bar to the electrolyte surface is permitted only thanks to the final solution of the corrosion issue of welding in the joining area of the conducting bar and the stainless steel plate of cathode.

As to the tensile strength of cathode (1) of this disclosure, it should be noted that nickel welding shows an outstanding strength as compared with such a copper welding of the conventional cathode. Tests made in this respect indeed show that cathodes welded with nickel as contributor, show a tensile strength 30% greater than those of cathodes welded with copper as contributor (tests performed by the. Metallurgic Engineering Department, Universidad de Santiago, Chile).

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A corrosion resisting joining area between copper and stainless steel or titanium which are the constituents of permanent cathodes for electrolytic processes wherein it is made by a first zone formed of a copper-nickel alloy (Cu—Ni), an intermediate zone of mostly nickel and a second zone made of a stainless steel-nickel allow which is the result of the participating materials becoming cast in a process of voltaic arc welding of the TIG, MIG type or manual arc welding process using pure nickel electrodes as contributing welding between said copper materials and a stainless steel material.

2. A joining area of claim 1 wherein the copper material is a conducting bar and the stainless steel or titanium material being a plate for forming cathodes.

3. Permanent cathodes for electrolytic processes with corrosion resisting joining areas between the copper and stainless steel or titanium wherein it comprises a conducting bar, a stainless steel or titanium plate and a joining area made by a first zone formed of a copper-nickel alloy (Cu—Ni), an intermediate zone with a mostly nickel alloy and a second zone made of a stainless steel-nickel allow which is the result of the participating materials becoming cast in the voltaic arc welding process of the TIG, MIG type or manual arc welding process using pure nickel electrodes as contributing welding between said copper materials and a stainless steel material.

4. Permanent cathodes for electrolytic processes of claim 3 wherein the conducting bar is straight.

5. Permanent cathodes for electrolytic processes of claim 3 wherein the conducting bar is curve and of the "horn" type.

6. Permanent cathodes for electrolytic processes of claims 4 and 5 wherein the conducting bar is of copper.

7. Permanent cathodes for electrolytic processes of claim 6 wherein the joining area is located between the conducting bar and the stainless steel plate.

* * * * *